US011874046B2

(12) United States Patent
Olvera

(10) Patent No.: US 11,874,046 B2
(45) Date of Patent: Jan. 16, 2024

(54) REFRIGERATOR WITH ICE MAKER HAVING A CAM DRIVEN RELEASE MECHANISM

(71) Applicant: Electrolux Home Products, Inc., Charlotte, NC (US)

(72) Inventor: Jose Carlos Trejo Olvera, Belton, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 314 days.

(21) Appl. No.: 17/091,887

(22) Filed: Nov. 6, 2020

(65) Prior Publication Data

US 2022/0146176 A1 May 12, 2022

(51) Int. Cl.
*F25C 1/243* (2018.01)

(52) U.S. Cl.
CPC ..... *F25C 1/243* (2013.01); *F25C 2305/022* (2013.01)

(58) Field of Classification Search
CPC .... F25C 1/00; F25C 1/04; F25C 1/045; F25C 1/06; F25C 2300/00; F25C 5/00; F25C 5/02; F25C 5/06; F25C 5/20; F25C 5/22; F25C 5/24; F25C 2305/022; F25C 2305/0221; F25C 2400/06; F25C 2500/02; F25C 2500/08; F25C 1/243
See application file for complete search history.

(56) References Cited

U.S. PATENT DOCUMENTS

| | | | | |
|---|---|---|---|---|
| 2,217,681 | A * | 10/1940 | Jennings | F25C 1/24 249/70 |
| 2,510,400 | A * | 6/1950 | Hurley | F25C 1/10 221/10 |
| 2,757,519 | A | 8/1956 | Sampson | |
| 3,060,700 | A * | 10/1962 | De Vincent | F25C 1/04 62/353 |
| 3,217,510 | A | 11/1965 | Kniffin et al. | |
| 3,382,682 | A | 5/1968 | Frohbieter | |
| 5,617,728 | A | 4/1997 | Kim et al. | |
| 6,044,658 | A * | 4/2000 | Ryu | F25C 1/04 62/353 |
| 2016/0223242 | A1* | 8/2016 | Garcia Gonzalez | F25C 5/04 |

FOREIGN PATENT DOCUMENTS

FR 1249724 A 3/1960

* cited by examiner

*Primary Examiner* — Emmanuel S Luk
*Assistant Examiner* — Inja Song
(74) *Attorney, Agent, or Firm* — Pearne & Gordon LLP

(57) ABSTRACT

A refrigerator has an ice maker. The ice maker has a longitudinal axis; a rotatable, stretchable ice cube tray having an upper face defining a plane offset from the longitudinal axis with openings for ice cubes and a bottom surface, and the upper face and the bottom surface being parallel to the longitudinal axis, the offset being at least a depth of an ice cube; and an axially mounted, rotatable cam with a convex surface, the cam is coaxial with the longitudinal axis and positioned between the longitudinal axis and the bottom surface of the tray, so that the convex surface is engageable with the bottom surface of the tray. Ice cubes are released by rotation of the cam as the convex surface outwardly flexes the tray.

12 Claims, 6 Drawing Sheets

REFRIGERATOR WITH ICE MAKER HAVING A CAM DRIVEN RELEASE MECHANISM

FIELD OF THE INVENTION

The invention is related to a domestic refrigerator with an ice maker having a cam driven release mechanism.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored. The freezer compartment is where food items that are to be kept in a frozen condition are stored. The refrigerators are provided with refrigeration systems that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment can be accessed without exposing the other compartment to the ambient air.

Ice makers typically have ice cubes with a pyramidal or tapered shape to facilitate cube removal (ejection/dumping) from the tray. While this has been a workable solution, there is a need to offer ice cubes with shapes other than the pyramidal or tapered shape, yet can still be easily removed (ejected/dumped) from tray. The invention disclosed below provides a solution to that problem.

SUMMARY OF THE INVENTION

A refrigerator has an ice maker. The ice maker has a longitudinal axis; a rotatable, stretchable ice cube tray having an upper face defining a plane offset from the longitudinal axis with openings for ice cubes and a bottom surface, and the upper face and the bottom surface being parallel to the longitudinal axis, the offset being at least a depth of an ice cube; and an axially mounted, rotatable cam with a convex surface, the cam is coaxial with the longitudinal axis and positioned between the longitudinal axis and the bottom surface of the tray, so that the convex surface is engageable with the bottom surface of the tray. Ice cubes are released by rotation of the cam as the convex surface outwardly flexes the tray.

DESCRIPTION OF THE DRAWINGS

For the purpose of illustrating the invention, there is shown in the drawings a form that is presently preferred; it being understood, however, that this invention is not limited to the precise arrangements and instrumentalities and scale shown.

DESCRIPTION OF THE INVENTION

Figure 1:
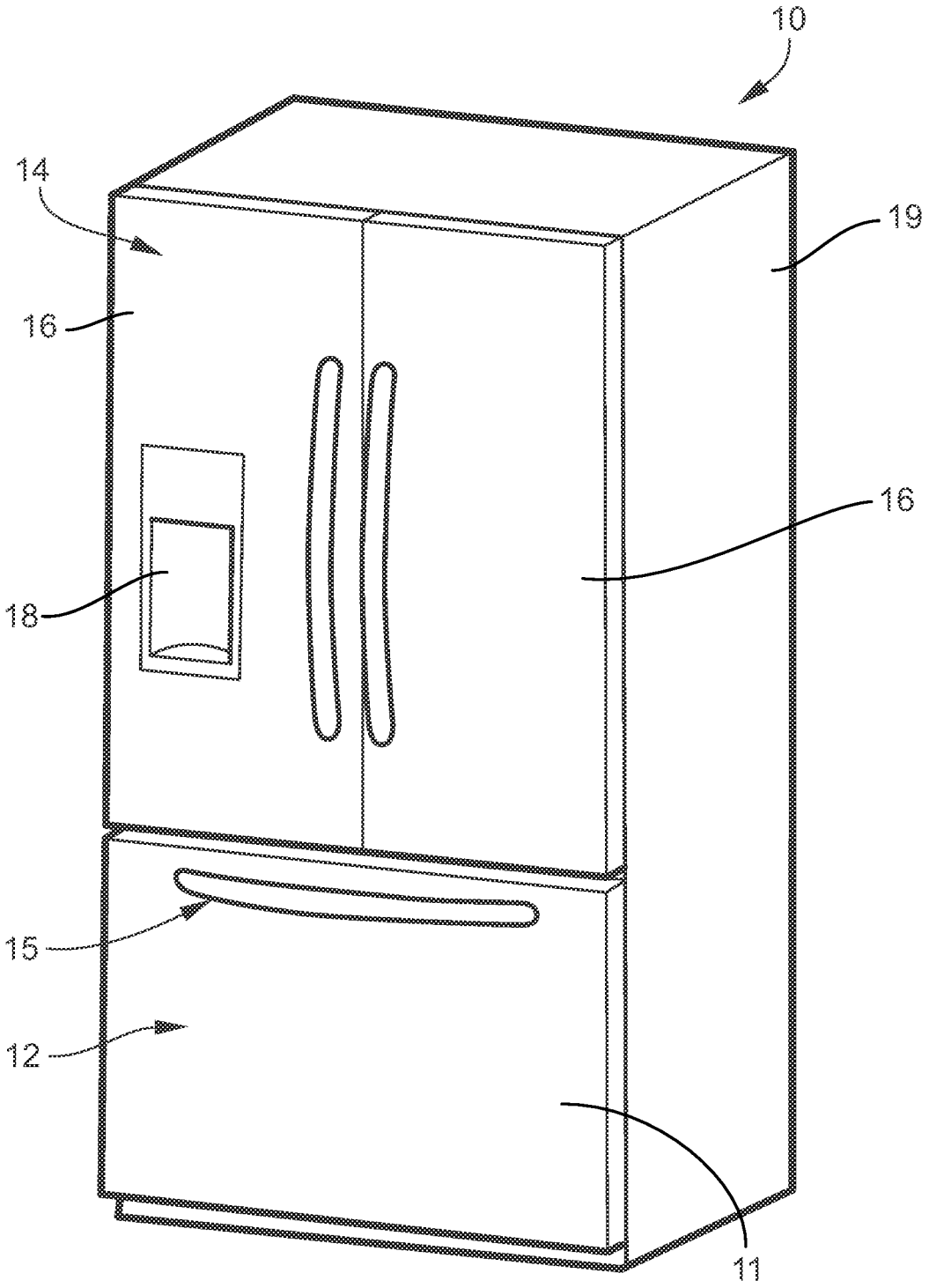
FIG. 1 is a front perspective view of a prior art household French door bottom mount refrigeration appliance showing doors of the fresh food compartment and drawer of a freezer compartment in a closed position.

Embodiments of a refrigerator or a component thereof now will be described with reference to the accompanying drawings. Whenever possible, the same reference numerals are used throughout the drawings to refer to the same or like parts.

Figure 2:
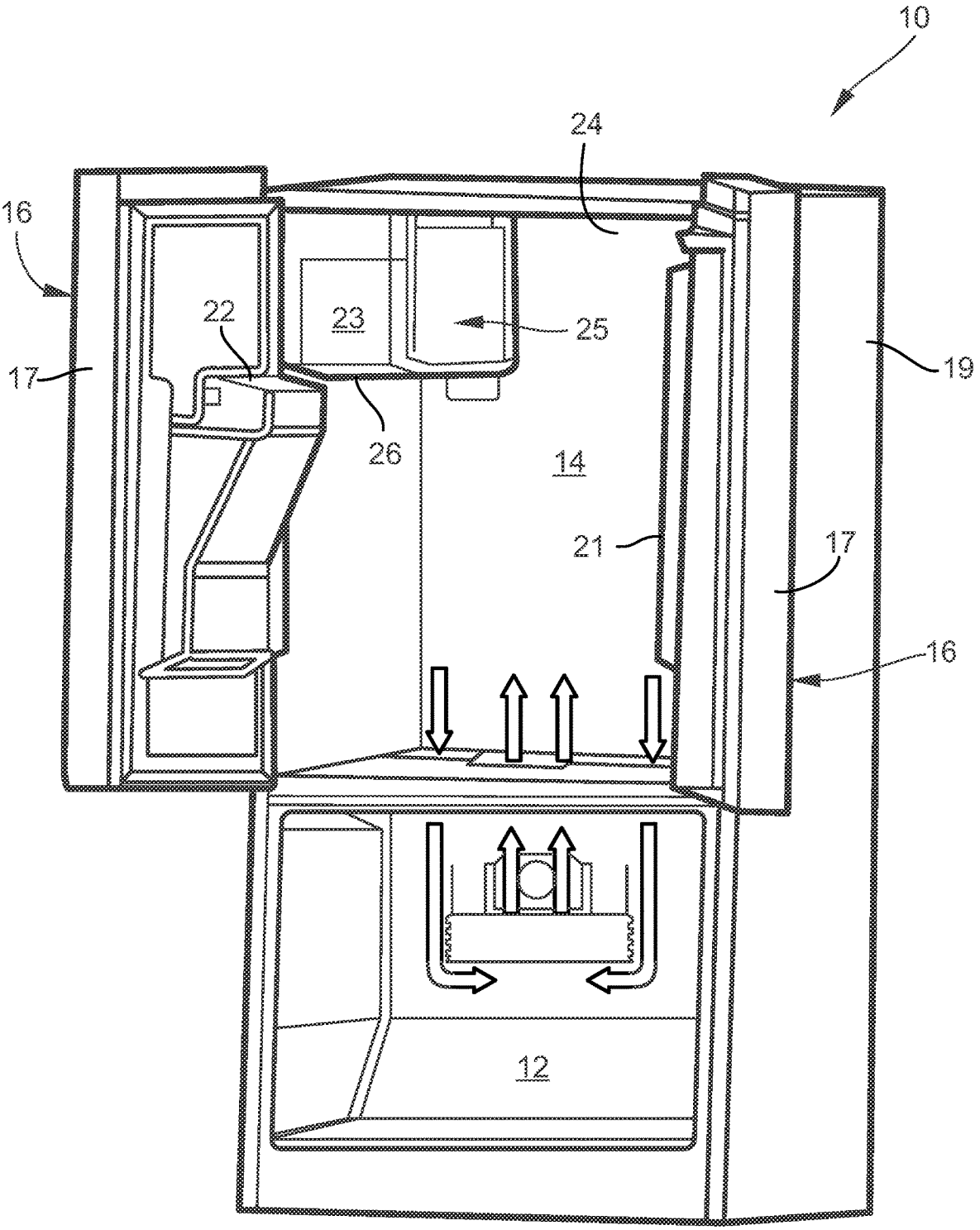
FIG. 2 is a front perspective view of the prior art refrigeration appliance of FIG. 1 showing the doors of the fresh food compartment in opened positions and the drawer of the freezer compartment removed.
Figure 3:
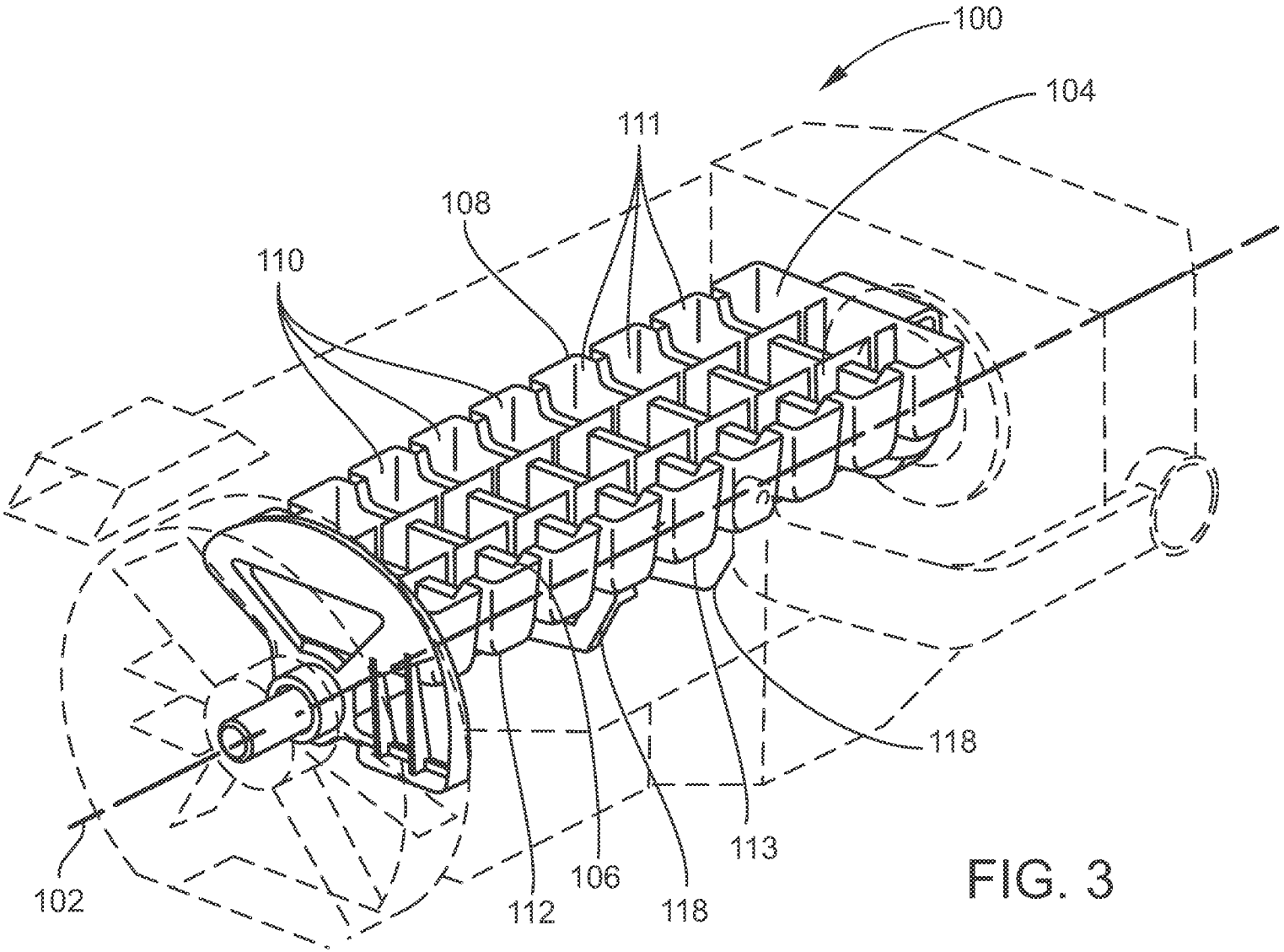
FIG. 3 is an isometric view of the inventive ice maker, shown with solid lines, broken lines illustrating other portions of the ice maker.
Figure 4:
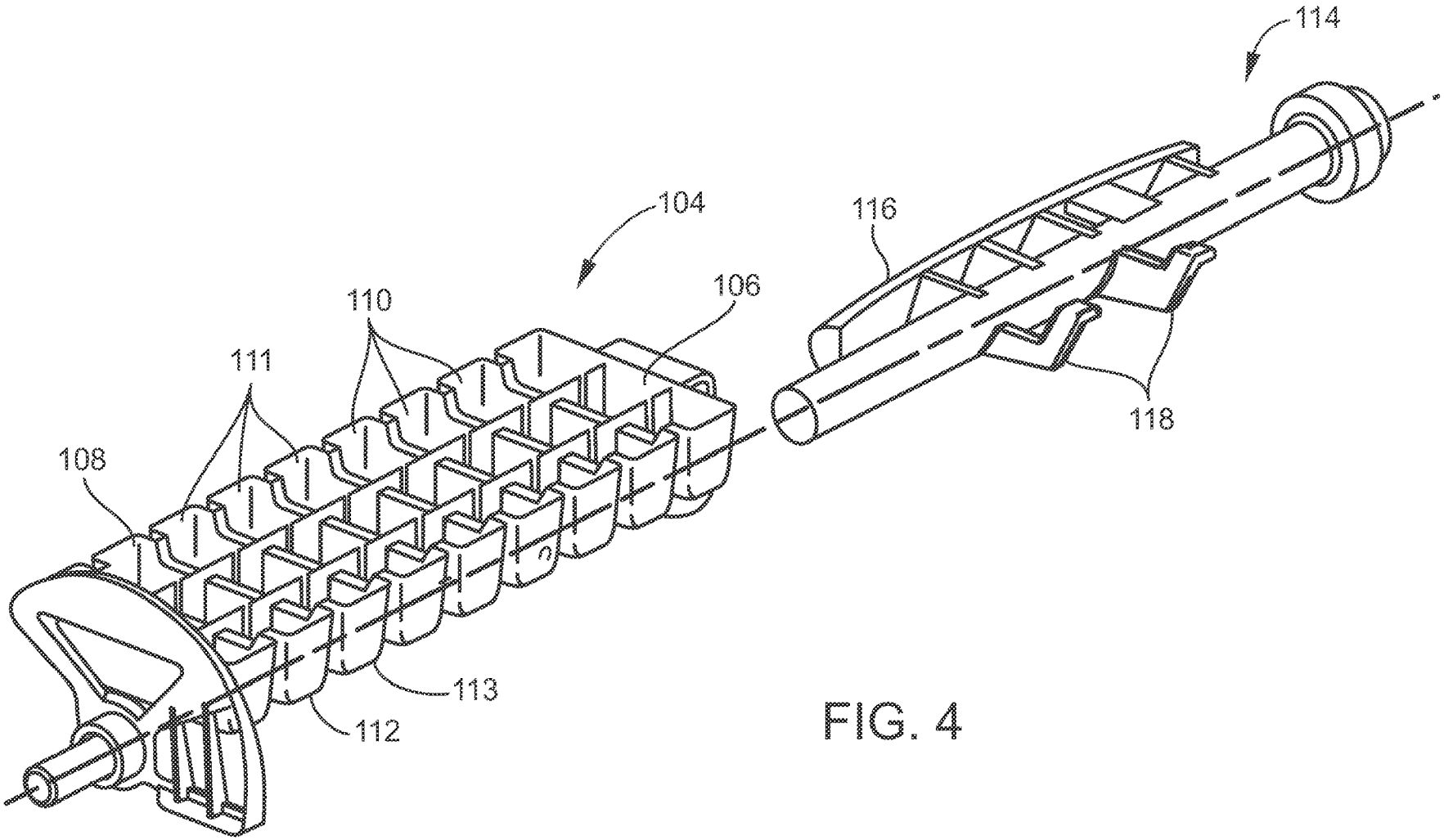
FIG. 4 is an exploded view of the ice tray and rotatable cam.

Referring now to the drawings, FIGS. 1 and 2 show a refrigeration appliance in the form of a domestic refrigerator, indicated generally at 10. Although the detailed description that follows concerns a domestic refrigerator 10, the invention can be embodied by refrigeration appliances other than a domestic refrigerator 10. An embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotably coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14.

For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotably coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation and forms an angle other than parallel relative to the door 16 when the center mullion 21 is in the second orientation. The seal and the externally exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause ice pieces to be dispensed from an ice bin 23 (FIG. 2) of an ice maker 25 disposed within the fresh food compartment 14. Ice pieces from the ice bin 23 can exit the ice bin 23 through an aperture 26 and be delivered to the dispenser 18 via an ice chute 22 (FIG. 2), which extends at least partially through the door 16 between the dispenser 18 and the ice bin 23.

The freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this aim by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12.

According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Referring to FIGS. 3-6, an embodiment of the inventive ice maker 100 is illustrated. The ice maker 100 is located within the refrigerator. In some embodiments, the ice maker 100 may be located in the freezer section of the refrigerator.

In general, ice maker 100 may include: longitudinal axis 102; a rotatable, stretchable ice cube tray 104 having an upper face 106 defining a plane 108 offset 107 from the longitudinal axis 102 with openings 110 for ice cubes (not shown) and a bottom surface 112, and the upper face 106 and the bottom surface 112 being parallel to the longitudinal axis 102, the offset 107 being at least a depth of an ice cube; and an axially mounted, rotatable cam 114 with a convex surface 116, the cam 114 is coaxial with the longitudinal axis 102 and positioned between the longitudinal axis 102 and the bottom surface 112 of the tray 104, so that the convex surface 116 is engageable with the bottom surface 112 of the tray 104. Ice cubes are released by rotation of the cam 114 as the convex surface 116 outwardly flexes the tray 104 (compare FIGS. 5 and 6).

Figure 5:
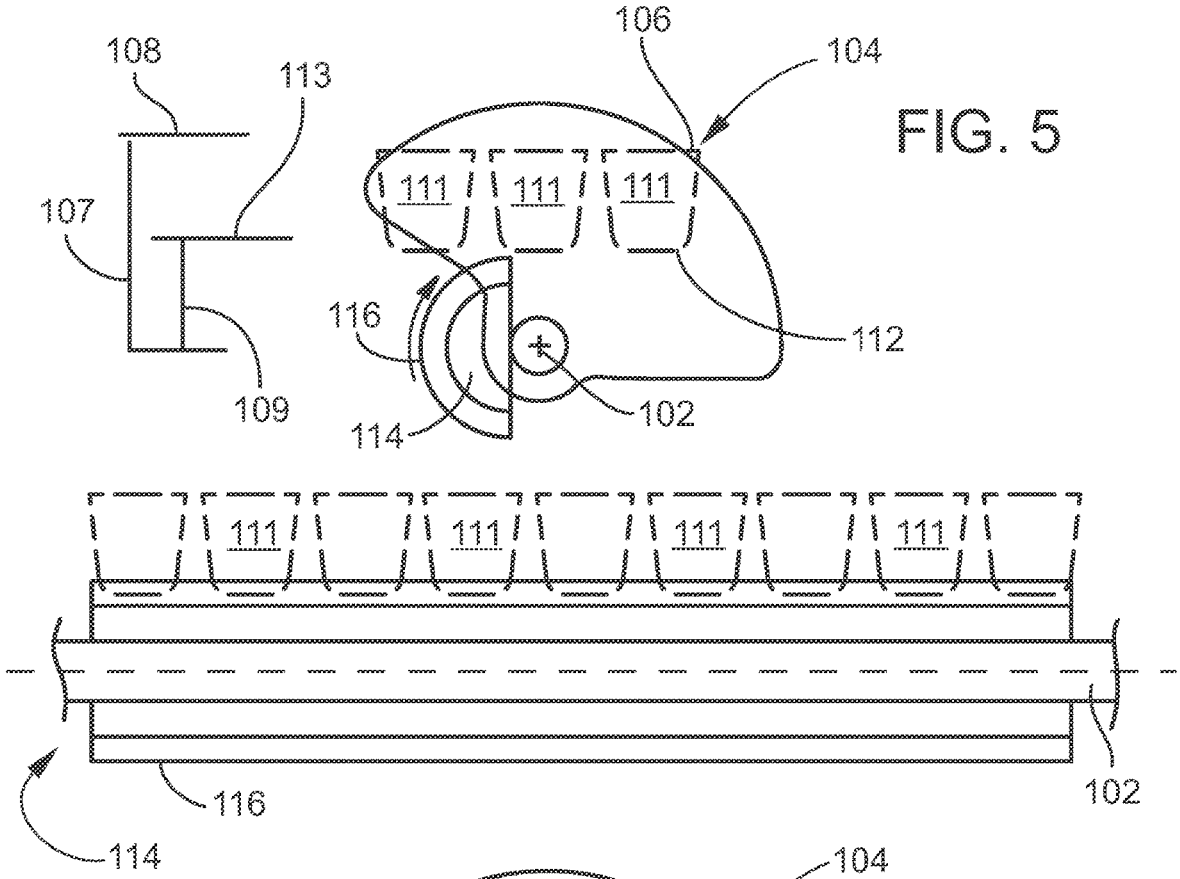
FIG. 5 is a schematic view of the cam before engagement with the tray (top is a side view and the bottom, an elevational view)
Figure 6:
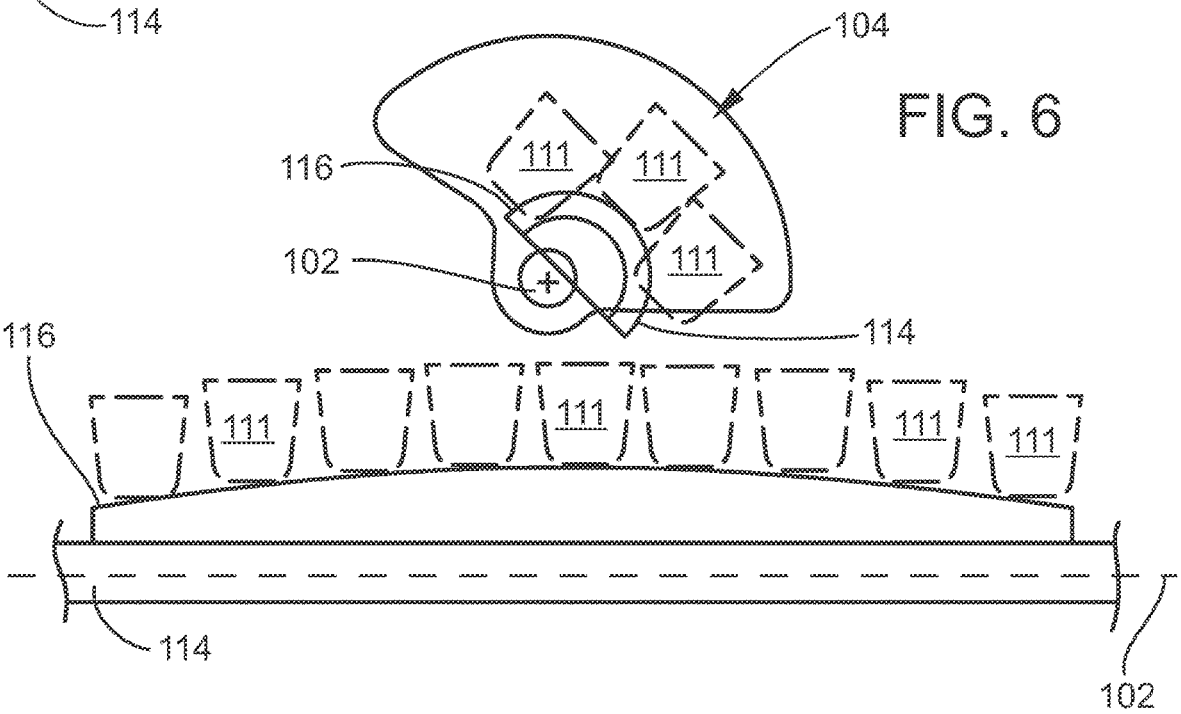
FIG. 6 is a schematic view of the cam in engagement with the tray (top is a side view and the bottom, an elevational view).

Alternatively, the ice maker 100 may include: a longitudinal axis 102; a rotatable, stretchable ice cube tray 104 having an upper face 106 defining an upper face plane 108 offset 107 from the longitudinal axis 102 with openings 110 for ice cubes (not shown) and a bottom surface 112 defining a bottom surface plane 113 offset 109 from the longitudinal axis 102, and the upper face plane 108 and the bottom surface plane 113 being parallel to the longitudinal axis 102, the upper face plane 108 offset 107 being at least a depth of an ice cube; and an axially mounted, rotatable cam 114 with a convex surface 116, the cam 114 is coaxial with the longitudinal axis 102 and positioned between the longitudinal axis 102 and the bottom surface 112 of the tray 104, so that the convex surface 116 is engageable with the bottom surface 112 of the tray 104, wherein ice cubes in the tray 104 are released by rotation of the cam 114 as the convex surface 116 outwardly flexes the tray 104 (compare FIGS. 5 and 6).

Figure 7:
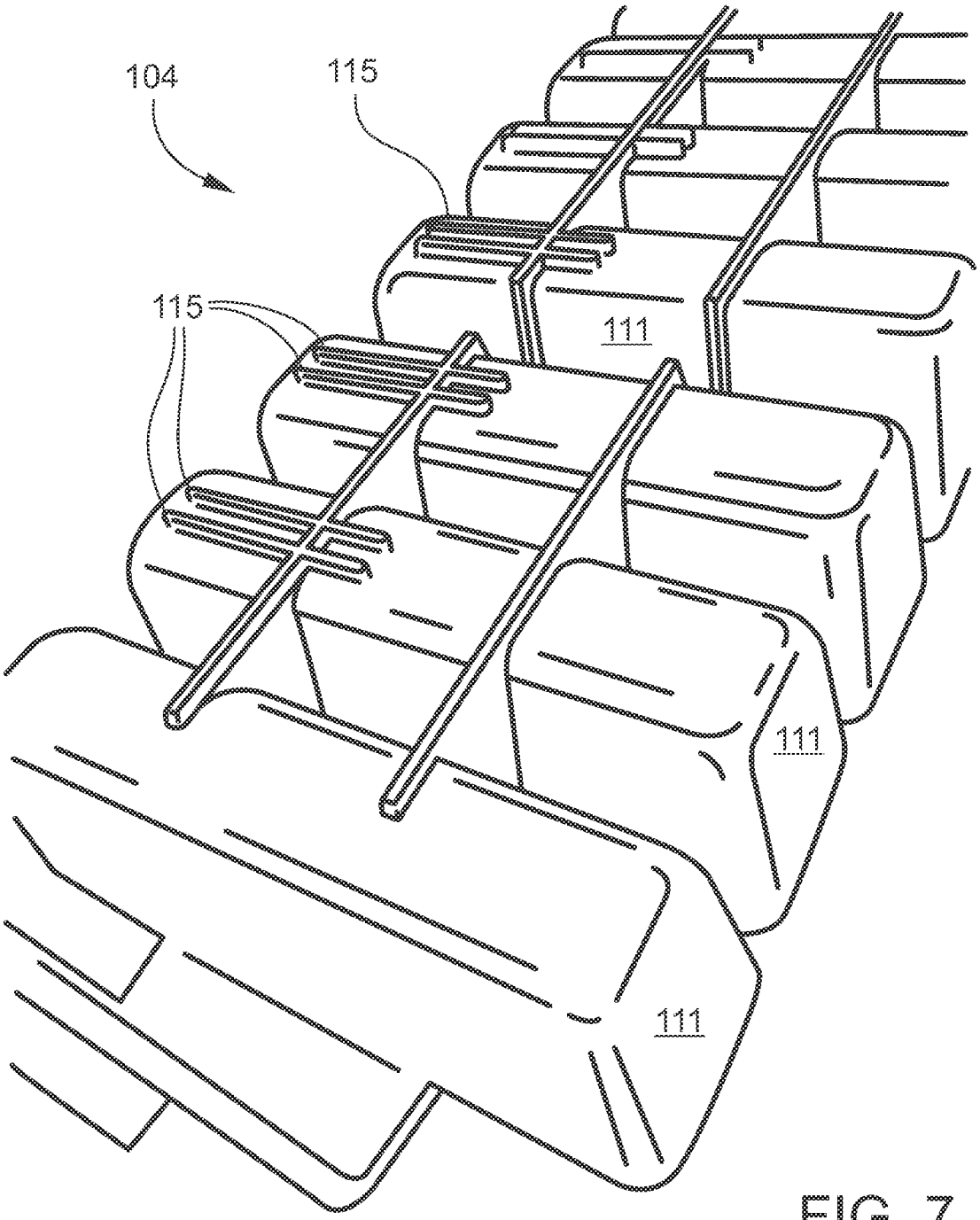
FIG. 7 is an illustration of the bottom surface of an embodiment of the tray.

Tray 104 is a stretchable or flexible tray. The flexibility may be imparted by, for example, the material of constructions, for example, a rubber type material of an elastic plastic (elastomer) material or by flexible joints between the individual cube molds. The tray 104 may include a plurality of cube molds 111 having opening 110. Cube molds 111 may have any shape. In some embodiments the cube mold shape may be pyramidal or non-pyramidal. FIG. 7 shows rails 115 used to facilitate sliding of the cam 114 along the bottom surface 112 of tray 104. Rails 115 may be located on the leading edge portion of the tray 104, i.e., that row of the cube molds 111 that would be first engaged with the cam 114.

Referring to FIG. 5 (particularly the upper view), the upper surface 106 may be defined by an imaginary plane 108. The bottom surface 112 may be defined by an imaginary plane 113. Plane 108 is offset 107 from axis 102. Offset 107 is at least the depth of a cube mold. Plane 113 is offset 109 from axis 102. Prior to the engagement of cam 114 with bottom surface 112, planes 108 and 113 are parallel and are parallel (or equidistantly offset) from axis 102.

Cam 114 is coaxial with axis 102 and rotates about axis 102. Cam 114 includes a convex surface 116 adapted to engage (and trigger the release of ice cubes) the bottom surface 112 of tray 104. Cam 114 may also include stops 118 that may be used to limit rotation and facilitate return of the tray to the initial position (FIG. 5). Convex surface 116, in some embodiments, may be long enough to contact all cube mold along the length of the tray 104, but this is not required. The convex surface 116 should be sufficiently long to trigger the release of ice cubes from the molds.

In operation (compare FIGS. 5 and 6), the initial (or water fill) position (FIG. 5) has the tray 104 is disengaged from cam 114 and planes 108 and 113 are parallel. In this position, cube molds 111 may be filled with water. In the discharge position (FIG. 6), the cam 114 is rotated and engages the tray 104 (including rails 115), tray 104 may also be rotated, and ice cubes are discharged (released/dumped) from molds 111. In rotation, the tray 104 may be inverted (not shown). Stops 118 may be used to return the tray to the initial position. Additionally, other stops (not shown) may be used to limit rotation of the cam and/or tray, as is conventionally known.

The present invention may be embodied in other forms without departing from the spirit and the essential attributes thereof, and, accordingly, reference should be made to the appended claims, rather than to the foregoing specification, as indicating the scope of the invention.

I claim:

1. A refrigerator comprising: an ice maker having a longitudinal axis;

a rotatable, stretchable ice cube tray having an upper face and a bottom surface, the upper face defining a plane that is offset from the longitudinal axis with openings for ice cubes, the upper face and the bottom surface being parallel to the longitudinal axis, and the plane being offset from the longitudinal axis by at least a depth of an ice cube; and an axially mounted, rotatable cam with a convex surface, the rotatable cam being coaxial with the longitudinal axis and positioned between the longitudinal axis and the bottom surface of the ice cube tray, so that the convex surface is engageable with the bottom surface of the ice cube tray, wherein both of the ice cube tray and the rotatable cam rotate in a same direction about the longitudinal axis, wherein the rotatable cam rotates relative to the ice cube tray during at least a portion of the ice cube tray's rotation about the longitudinal axis, and wherein said relative rotation of the rotatable cam with respect to the ice cube tray causes the convex surface to engage and outwardly flex a portion of the ice cube tray.

2. The refrigerator of claim 1 wherein the stretchable ice cube tray is flexible.

3. The refrigerator of claim 2 wherein the ice cube tray is made of rubber-type material or elastic plastic material.

4. The refrigerator of claim 1 wherein the ice cube tray includes a plurality of ice cube molds.

5. The refrigerator of claim 4 wherein at least one of the plurality of ice cube molds has a pyramidal shape.

6. The refrigerator of claim 4 wherein at least one of the plurality of ice cube molds has a non-pyramidal shape.

7. A refrigerator comprises: an ice maker having a longitudinal axis;

a rotatable, stretchable ice cube tray having an upper face defining an upper face plane that is offset from the longitudinal axis with openings for ice cubes and a bottom surface defining a bottom surface plane that is offset from the longitudinal axis, the upper face plane and the bottom surface plane being parallel to the longitudinal axis, and the offset from the longitudinal axis to the upper face plane being at least a depth of an ice cube; and an axially mounted, rotatable cam with a convex surface, the rotatable cam being coaxial with the longitudinal axis and positioned between the longitudinal axis and the bottom surface of the ice cube tray, so that the convex surface is engageable with the bottom surface of the ice cube tray, wherein both of the ice cube tray and the rotatable cam rotate in a same direction about the longitudinal axis, and wherein ice cubes in the ice cube tray are released by relative rotation of the rotatable cam with respect to the ice cube tray caused by the convex surface engaging to outwardly flex the ice cube tray.

8. The refrigerator of claim 7 wherein the stretchable ice cube tray is flexible.

9. The refrigerator of claim 8 wherein the ice cube tray is made of rubber-type material or elastic plastic material.

10. The refrigerator of claim 7 wherein the ice cube tray includes a plurality of ice cube molds.

11. The refrigerator of claim 10 wherein at least one of the plurality of ice cube molds has a pyramidal shape.

12. The refrigerator of claim 10 wherein at least one of the plurality of ice cube molds has a non-pyramidal shape.

* * * * *